US006869388B2

(12) United States Patent
Kostiza

(10) Patent No.: US 6,869,388 B2
(45) Date of Patent: Mar. 22, 2005

(54) FOLDING BLADE CYLINDER OF A FOLDING MACHINE

(75) Inventor: Simon Kostiza, Fussgönheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/467,173

(22) PCT Filed: Dec. 6, 2001

(86) PCT No.: PCT/DE01/04588

§ 371 (c)(1),
(2), (4) Date: Aug. 14, 2003

(87) PCT Pub. No.: WO02/064473

PCT Pub. Date: Aug. 22, 2002

(65) Prior Publication Data

US 2004/0084826 A1 May 6, 2004

(30) Foreign Application Priority Data

Feb. 14, 2001 (DE) ..... 101 06 671

(51) Int. Cl.[7] ..... B31F 1/08

(52) U.S. Cl. ..... 493/424; 493/426; 493/429; 493/434

(58) Field of Search ..... 493/424–426, 493/429, 434

(56) References Cited

U.S. PATENT DOCUMENTS 4,790,804 A * 12/1988 Gotou et al. ..... 493/226
5,078,374 A 1/1992 Odeau
5,429,578 A 7/1995 Calbrix et al.
5,846,177 A * 12/1998 Mayr ..... 493/424
6,071,224 A 6/2000 Lanvin et al.
6,128,988 A * 10/2000 Hillebrand et al. ..... 83/115
6,159,138 A * 12/2000 Lanvin et al. ..... 493/359
6,165,118 A * 12/2000 Eckert ..... 493/425
6,251,053 B1 * 6/2001 Lanvin et al. ..... 493/359
6,279,890 B1 * 8/2001 Tomczak ..... 270/21.1
6,331,154 B1 * 12/2001 Shibuya et al. ..... 493/424
6,514,188 B2 * 2/2003 Kostiza ..... 493/424
6,673,004 B2 * 1/2004 Nanba et al. ..... 493/428
6,730,011 B2 * 5/2004 Tokiwa et al. ..... 493/405

FOREIGN PATENT DOCUMENTS

DE 1 222 082 8/1966
DE 43 35 048 A1 4/1994
DE 690 08 007 T2 11/1994
DE 197 21 913 A1 2/1998

* cited by examiner

*Primary Examiner*—Rinaldi I. Rada
*Assistant Examiner*—Hermant M. Desai
(74) *Attorney, Agent, or Firm*—Jones, Tullar & Cooper, PC

(57) ABSTRACT

A folding blade cylinder for use in a folding machine includes a cylindrical cradle and a folding blade that can be situated in various positions in the cylindrical cradle. Each position of the folding blade corresponds to a gap in the cylinder cradle surface. These gaps are separated from ach other by segments of the cylindrical cradle. In order to move the folding blade from one gap to another, the folding blade is retracted into the interior of the folding blade cylinder.

18 Claims, 5 Drawing Sheets

FOLDING BLADE CYLINDER OF A FOLDING MACHINE

FIELD OF THE INVENTION

The present invention is directed to a folding blade cylinder of a folding machine. The folding blade cylinder has a cylindrical cradle or saddle and a folding blade which can be extended from an opening gap in the cradle and which can be displaced circumferentially between different positions on the folding blade cylinder.

BACKGROUND OF THE INVENTION

Folding blade cylinders are employed, typically acting together with a folding jaw cylinder, for making a transverse fold in a sheet of material which is passing through a gap between the folding blade cylinder and the folding jaw cylinder. To accomplish this, at least one folding blade in the folding blade cylinder can be moved between an inactive position, in which it does not protrude outwardly past the exterior surface of the folding blade cylinder, and an active position in which the folding blade extends out past the folding blade surface. In the active position, the folding blade pushes the sheet to be folded into a gap in the oppositely located folding jaw cylinder, which gap is subsequently closed. The folding jaw cylinder then conveys the folded sheet clamped in the fold further.

In order to be able to fold sheets in various formats by the use of such a folding blade cylinder, or to form different folds, it is necessary to be able to displace the folding blade on the circumference of the folding blade cylinder between different positions. However, the exterior surface of the folding blade cylinder should be cylindrically closed to as great an extent as possible in order to assure the precise guidance of the sheets of metal.

DE 43 35 048 A1 describes a folding blade cylinder for a folding apparatus with a single gap for the folding blade. The folding blade can be displaced inside this gap in the circumferential direction of the folding blade cylinder.

DE 690 08 007 T2 shows a folding blade cylinder with a folding blade. The folding blade can be moved into a working and a rest position for different types of folds.

DE 12 22 082 A discloses a folding blade cylinder of a cylinder folding apparatus. The folding blades can be displaced, in the retracted position, in the circumferential direction in the interior of the folding blade cylinder.

SUMMARY OF THE INVENTION

The object of the present invention is directed to on providing a folding blade cylinder of a folding machine.

In accordance with the present invention, this object is attained by the provision of a folding blade cylinder of a folding apparatus. The folding blade cylinder has a circumferential cradle and a folding blade which can be extended radially from a gap of the cradle. The folding blade can be displaced circumferentially between different positions on the folding blade cylinder. A plurality of gaps are provided in the circumferential direction of the folding blade cylinder cradle. The folding blade can be selectively displaced so that it lies opposite different ones of those plurality of gaps.

The advantages to be gained by the present invention lie, in particular, in that an impediment to the displacement of the blade cylinder by the accumulation of paper dust or of similar foreign materials is made impossible, even after a long period of use of the folding blade cylinder with a particular format. Another advantage of the present invention consists in that the formation of tooth-shaped impressions in the sheet to be folded are prevented.

To this end, in place of a single displaceable gap, the cradle has a plurality of gaps which are each assigned to a folding blade. The folding blade can be retracted into the interior of the folding blade cylinder sufficiently far so that the folding blade can be displaced in the interior of the folding blade cylinder between different folding blade positions, each of which folding blade positions being located opposite one of the gaps.

This can be accomplished for one reason because the lift of the folding movement can be selected to be so large that, in its inactive position, the folding blade is located radially inside the interior surface of the cradle. The folding blade can be freely displaced in this position. Another option is to provide a reduced lift of the folding movement between the extended active and the retracted inactive positions of the folding blade. In the inactive position, the folding blade is at least partially located outside of the inner surface of the cradle. The folding blade can be embodied so that it can be retracted behind the interior surface of the cradle in order to make possible the displacement of the folding blade to another cylinder or cradle gap.

Customarily, the radial movement of such a folding blade is controlled by a lever which runs against or on a control cam. In order to be able to retract the folding blade past the usual inactive position, it is possible to provide an actuator that is usable for lifting the lever off this control cam. Such an actuator can be a lift cylinder, for example. Electromagnetically driven actuators can also be considered. A second control cam can also be provided, which second control cam can be displaced against the first control cam and which second control cam has a section which can be brought into contact with the lever arm by this displacement in order to retract the folding blade into the interior of the folding blade cylinder and into a position behind the interior surface of the cradle.

To prevent the edges of the gap or gaps in the cradle of the folding blade cylinder from pressing into the sheet to be folded, the exteriorly located longitudinal edges of the gaps can be beveled.

Furthermore, a closing body is preferably provided which closing body, coupled with the displacement of the folding blade, can be displaced between one position, in which it does not close a gap occupied by the folding blade, and a second position wherein it is not retracted into the interior of the folding blade cylinder. Such a closing body can also counteract the formation of an indentation, in particular if it rests flush with the exterior surface of the cradle on a portion of the exterior surface. However, the closing body is more important in that it prevents the introduction of a free end of a sheet into an otherwise open gap.

To ease the displacement of the closing body, and therefore also that of the folding blade, the closing body and/or the gap which can be closed off by the closing body are beveled on their ends facing each other. A spring element can be used for maintaining the closing body in its position by the use of a radially outwardly exerted spring pressure.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
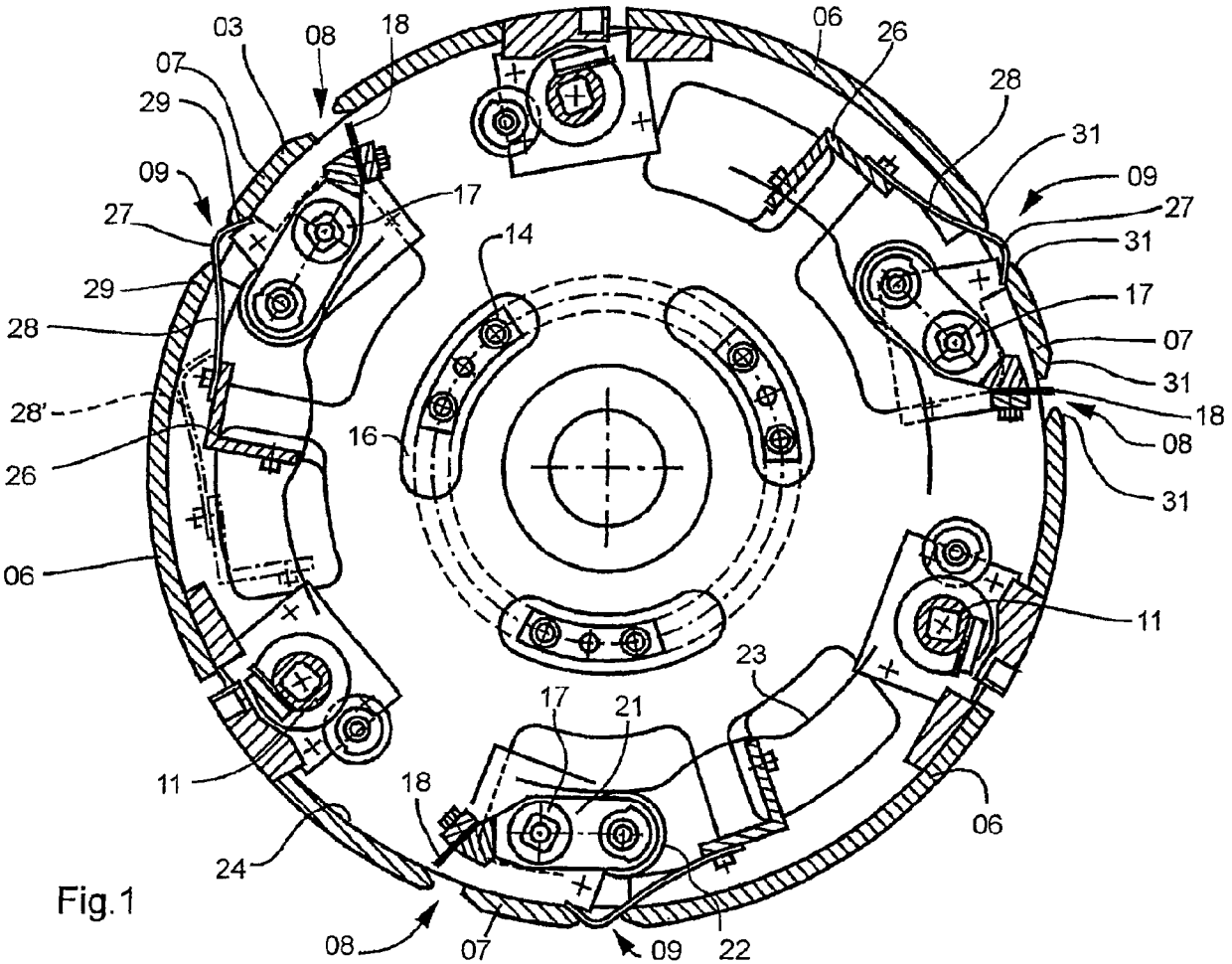
FIG. 1, a schematic radial cross-section through a folding blade cylinder in accordance with the present invention, in FIG. 2, an axial cross-section through the folding blade cylinder in FIG. 1, in FIG. 3, a first modification of the folding blade in a radial partial cross-section, in FIG. 4, a second modification of the folding blade in a radial partial cross-section analogous to the view shown in FIG. 3, and in FIG. 5, a third modification of the folding blade in a radial partial cross-section analogous to the view shown in FIG. 3.
Figure 2:
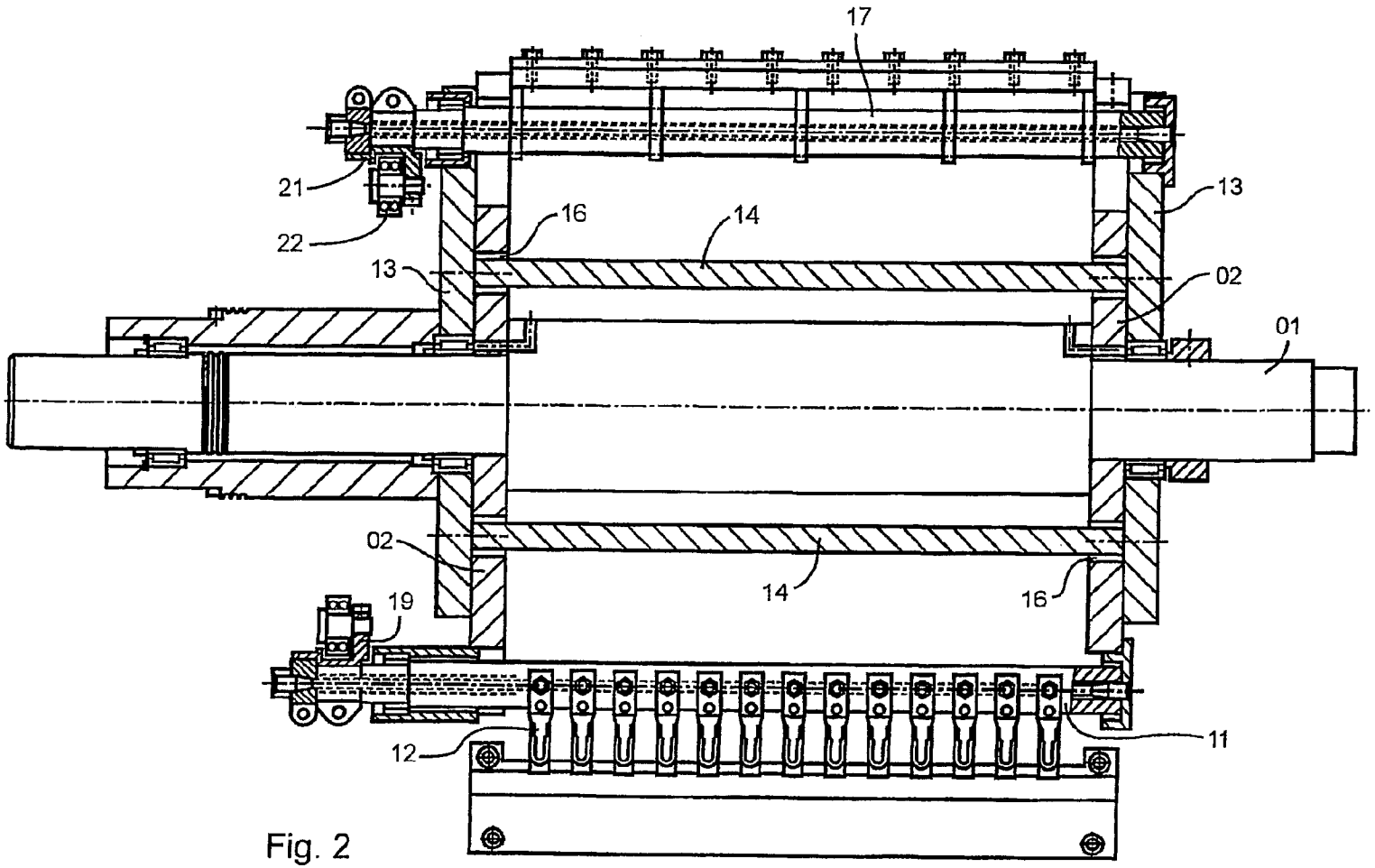

A first preferred embodiment of the folding blade cylinder in accordance with the present invention, and shown in a radial cross-section, and in an axial cross-section is represented in FIGS. 1 and 2, respectively. The axial cross-section shown in FIG. 2 shows a shaft 01, to which two flanges 02 have been screwed, which flanges 02 are fixed against relative rotation with respect to shaft 01. These flanges 02 support a cradle 03, as seen in FIG. 1, of the folding blade cylinder which cradle 03, in this first preferred embodiment, has been put together from six cradle segments 06, 07, which are respectively separated by gaps 08, or 09, with these cradle segments 06, 07 and their associated gaps 08, 09 extending radially over the entire distance of the folding blade cylinder between the flanges 02.

Three holding elements 12 that are each equipped with grippers extend through slits placed in the segments 06. These three holding elements 12 are each mounted on respective spindles 11, which spindles 11 are, in turn, pivotably suspended between the two inboard flanges 02.

Two additional, outboard flanges 13 are arranged so as to be supported by and rotatable around the shaft 01 and parallel with the flanges 02, as seen in FIG. 2. Cross arms 14 are secured to the outboard flanges 13 and extend axially through elongated holes 16 each formed in the shape of a segment of a circle in the flanges 02 and connect the flanges 13 with each other for coupling the rotary movement of the flanges 13. As represented in FIG. 1, in the area between the flanges 02 the cross arms 14 are combined into a hollow cylinder surrounding the shaft 1 in order to achieve the greatest possible torsional rigidity for the folding blade cylinder.

Figure 3:
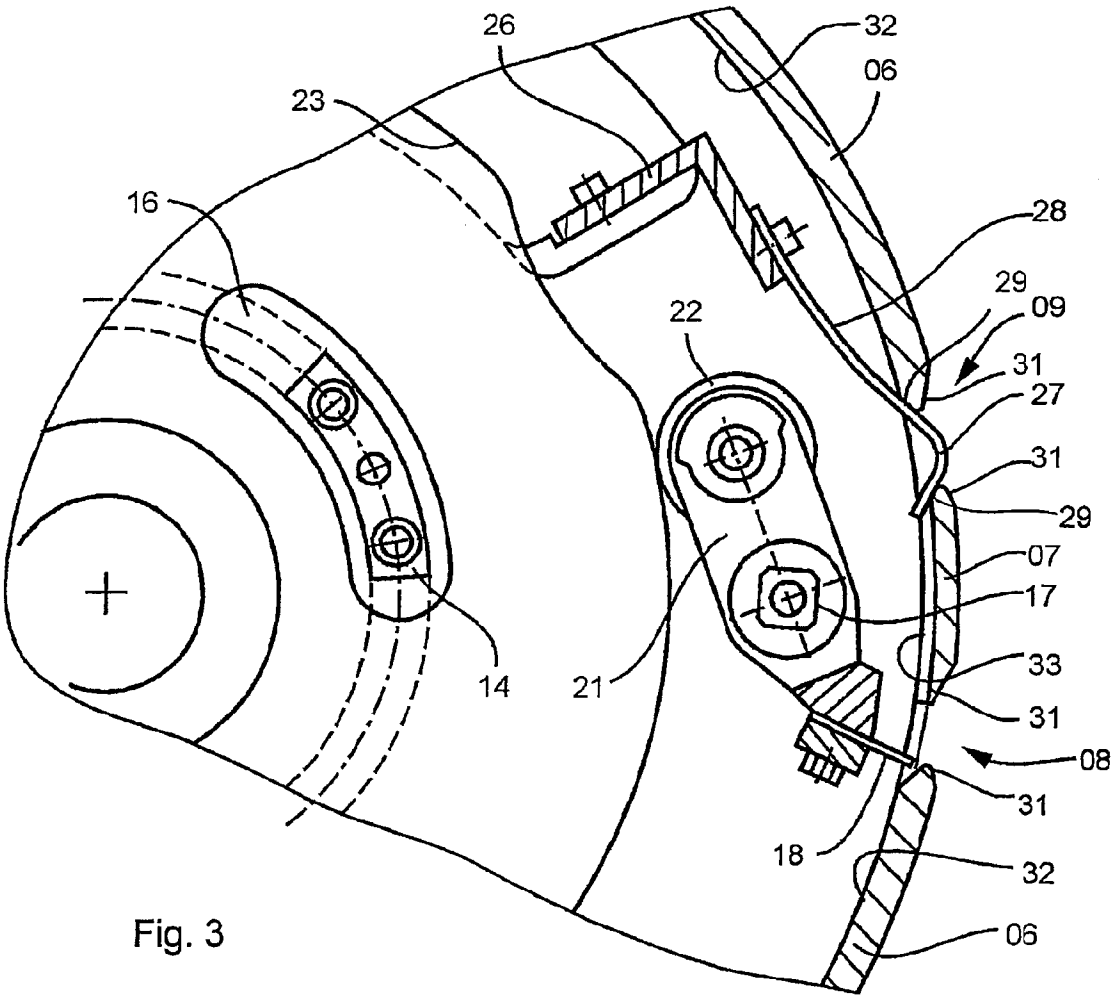

Three spindles 17 of folding blades 18 are rotatably seated on the outboard flanges 13, as seen in FIGS. 1 and 2. Each one of the grippers 12 and the folding blades 18 performs a back-and-forth movement in time with the rotation of the folding blade cylinder, which back-and-forth movement is controlled in a generally known manner by levers 19, or 21, respectively that are mounted on axial ends of the spindles 11, or 17, respectively. These levers 19, 21 support rollers 22 on their ends, which rollers 22 each roll off on control cams 23, as seen in FIG. 3. These control cams 23 are in the form of stationary disks. They are not represented in FIG. 2, and in FIG. 1 are shown only in the form of parts of a surface, as shown by the discontinuous line 23 in FIG. 1.

In order to differentiate between the three folding blades 18 represented in FIG. 1, in the discussion which follows these three folding blades 18 will also be called the right, left, or lower folding blades 18, all with reference to their respective locations in FIG. 1. The left and the lower folding blades 18 depicted in FIG. 1 are in an inactive position in their folding movement, in which inactive positions they have been retracted radially inwardly as far as possible to positions behind an inner surface 24 of the cradle 03. The right folding blade 18 depicted in FIG. 1 is in an extended, active position, in which its tip or outer end slightly protrudes past an outer surface of the cradle 03 and is therefore capable of pushing a sheet, which is carried along on the folding blade cylinder by the gripper 12, into a folding jaw of an oppositely located folding jaw cylinder, which is not specifically represented.

In a position of the folding blade cylinder, which is slightly displaced with respect to the represented position of the folding blade cylinder shown in FIG. 1, all three folding blades 18 are in the retracted inactive position. In this second, retracted position, it is possible to release a fixed coupling, which is not specifically shown, between the outboard flanges 13 and the inboard flanges 02 and thus to displace the folding blades 18 in relation to the cradle 03 in a counterclockwise direction in FIG. 1, so that each of the folding blades 18 comes to rest in front of a gap 08, 09. The control cam 23, which is responsible for controlling the folding movement of the folding blades 18, is not rotated along in the course of this movement of the flanges 13 and 02 with respect to each other, so that even after the displacement of the flanges the location at which the folding blades 18 are extended remains at the place where the circumference of the folding blade cylinder touches the folding jaw cylinder, which folding jaw cylinder is not specifically represented.

In the embodiment of the folding blade cylinder represented in FIG. 1, the two flanges 13 are connected with each other by L-shaped profiled elements 26 which, on their legs facing the inner surface 24 of the cradle 03, support a closing body 27 which is pressed against the inner surface 24 of the cradle 03 by a spring element 28. In this case, the spring element 28 and the closing body 27 are configured in one piece as a spring plate which is extending in the axial direction of the folding blade cylinder over the entire length of the gaps 09. The closing bodies 27 are arranged in relation to the folding blades in such a way that they close the gaps 09 when the folding blades 18 are aligned with the gaps 08, as represented in FIG. 1. These closing bodies 27 prevent a free end of a sheet that is being folded by the folding blades 18 from springing into the gap 09 and from getting snagged there. This is particularly useful if the gap 08 corresponds to a delta folding position, which corresponds to a second transverse fold, and the gap 09 corresponds to a first transverse folding position.

When the folding blades 18 are aligned with the gaps 09, the closing bodies 27 have retracted into the interior of the folding blade cylinder. Such a retracted closing body 27 is represented by a dash-dotted line in FIG. 1 and is identified as 28'. On their interior surfaces, the gaps 09 each have beveled interior flanks 29 which, as seen more clearly in FIG. 3, and together with the curved exterior shape of the closing body 27, make it easier for the dosing body 27 to retract into the interior of the folding blade cylinder in the course of a displacement of flanges 13 with respect to flanges 02.

Similar exterior beveled surfaces 31 are formed on each of the outer edges of each of the gaps 08, 09, again as seen most clearly in FIG. 3 in order to prevent these outer edges from leaving pressure indentations on the sheets to be processed by the folding blade cylinder.

FIG. 3 shows a partial cross-section through a further embodiment of a folding blade cylinder in accordance with the present invention. The difference between this embodiment and the embodiment shown in FIG. 1 lies in that in the embodiment shown in FIG. 3 the narrow cradle element 07, under which the folding blade can move from the gap 08 to the gap 09 and back, is thinner than the wide segments 06 on each of which the grippers, which are not represented in FIG. 3, are arranged. FIG. 3 shows the folding blade 18 in its retracted, inactive position. The tip of the folding blade 18 is located radially outward of the inner surfaces 32 of the thicker segments 06, but radially inside of the inner surfaces 33 of the thinner segments 07. In this way, the reduced thickness of the segment 07 permits the reduction of the lift of the folding movement of the folding blade 18, but still allows it to displace it as needed between the two gaps 08, 09. Along with the reduced lift of the folding movement, the accelerations to which the folding blade, or its spindle 17, are subjected are also reduced. This allows for the operation of the folding blade cylinders at a greater rotary speed and/or with reduced wear.

Figure 4:
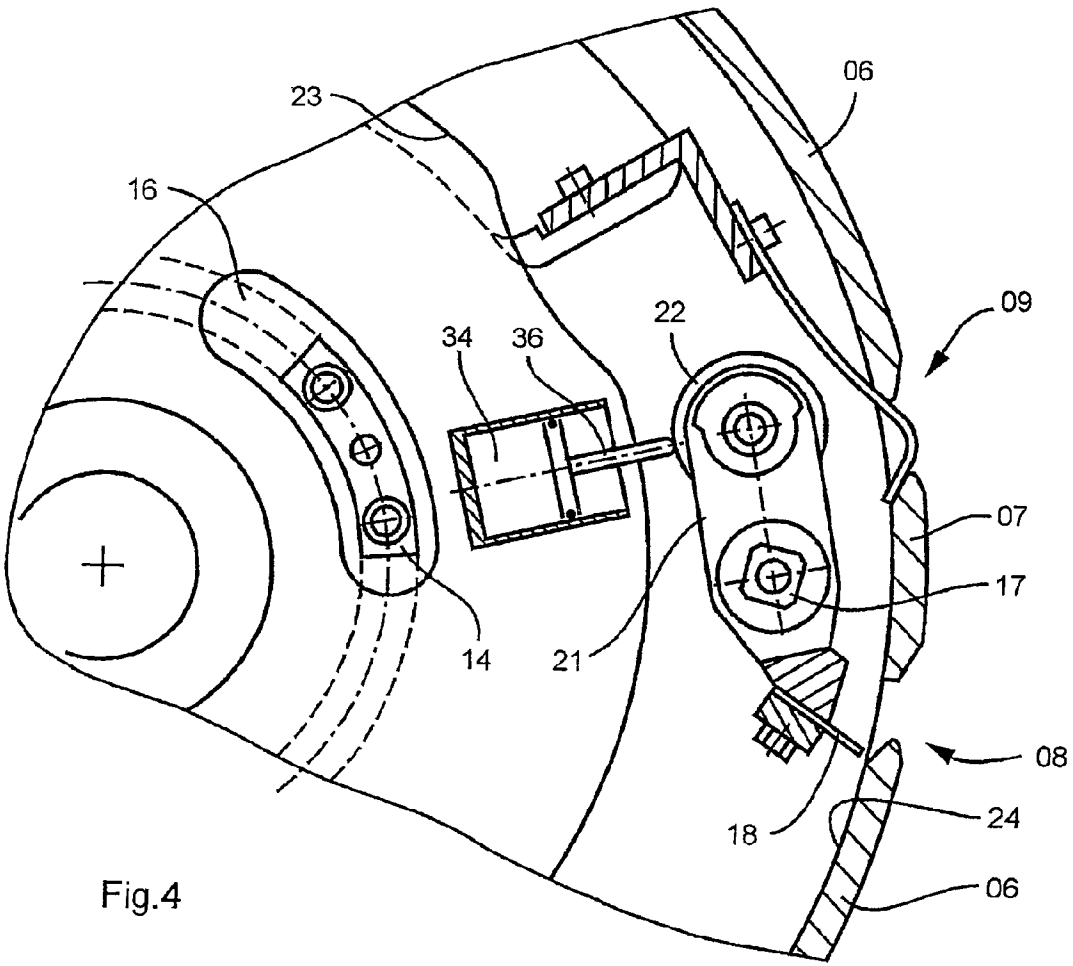

A second further embodiment of a folding blade cylinder in accordance with the present invention is represented in FIG. 4 in a cross-sectional view which is analogous to the one shown in FIG. 3. In the second further embodiment the thickness of the cradle segments 06, 07 is again the same, as in the case in the embodiment shown in FIG. 1. However, the control cam 23 is now shaped in such a way that only a lift of the folding movement, which lift is reduced in comparison with the embodiment in FIG. 1, is achieved. Thus, in the inactive, retracted position of the lifting movement, which is not depicted in FIG. 4, the tip of the folding blade 18 is located radially between the cradle inner surface 24 and the outer surface of the cradle 03. In order to make possible a displacement of the folding blades 18 between the two gaps 08, 09 in spite of this inactive or retracted position of the folding blade tip, linear actuators, which are in this case configured as hydraulic cylinders 34, are provided. The number of these linear actuators corresponds to the number of folding blades 18 and these linear actuators are arranged distributed at the same angular distance. One of these hydraulic cylinders 34 is represented in FIG. 4. It is mounted on the flange 13, which also supports the folding blades 18, so that it always remains in the same position with respect to the folding blade 18 assigned to it, and independently of the rotary position of the folding blade cylinder. The linear actuator, configured as a hydraulic cylinder 34, has an outwardly oriented piston with a piston rod 36, which piston rod 36 is located exactly opposite an end area of the lever 21, or of the roller 22 mounted on the lever 21, which roller 22 is mounted for rolling off on the control cam 23. By extending the piston, and thus the piston rod 36, the roller 22 is lifted off the control cam 23, and the folding blade 18 moves radially inwardly back past the inactive position represented in FIG. 4 and into the interior of the folding blade cylinder. As described in connection with FIGS. 1 and 2, the flanges 13, 02 can be rotated in respect to each other in this position of the folding blades 18 in order to displace the folding blades 18 out of their position at the gap 08 into the one at the gap 09, or vice versa.

It would also be possible to mount the linear actuators fixed in place, in particular mounted on the control cam 23, and to provide the piston rod 36 on its distal end with a cam section facing the roller 22, which cam section would be at least sufficiently long for the roller 22 to be able to roll off on it in the course of the displacement of the folding blade 18 from the gap 08 to the gap 09 or vice versa. In this way the folding blade 18 would be maintained at a safe distance from the inner surface 24 of the cradle 03 during the entire displacement movement of the folding blades 18. Typically, this distance can be approximately 1.5 mm.

The hydraulic cylinder 34 can be replaced by other types of linear actuators. For example, linear actuators with an electromagnetic drive mechanism could be utilized.

Figure 5:
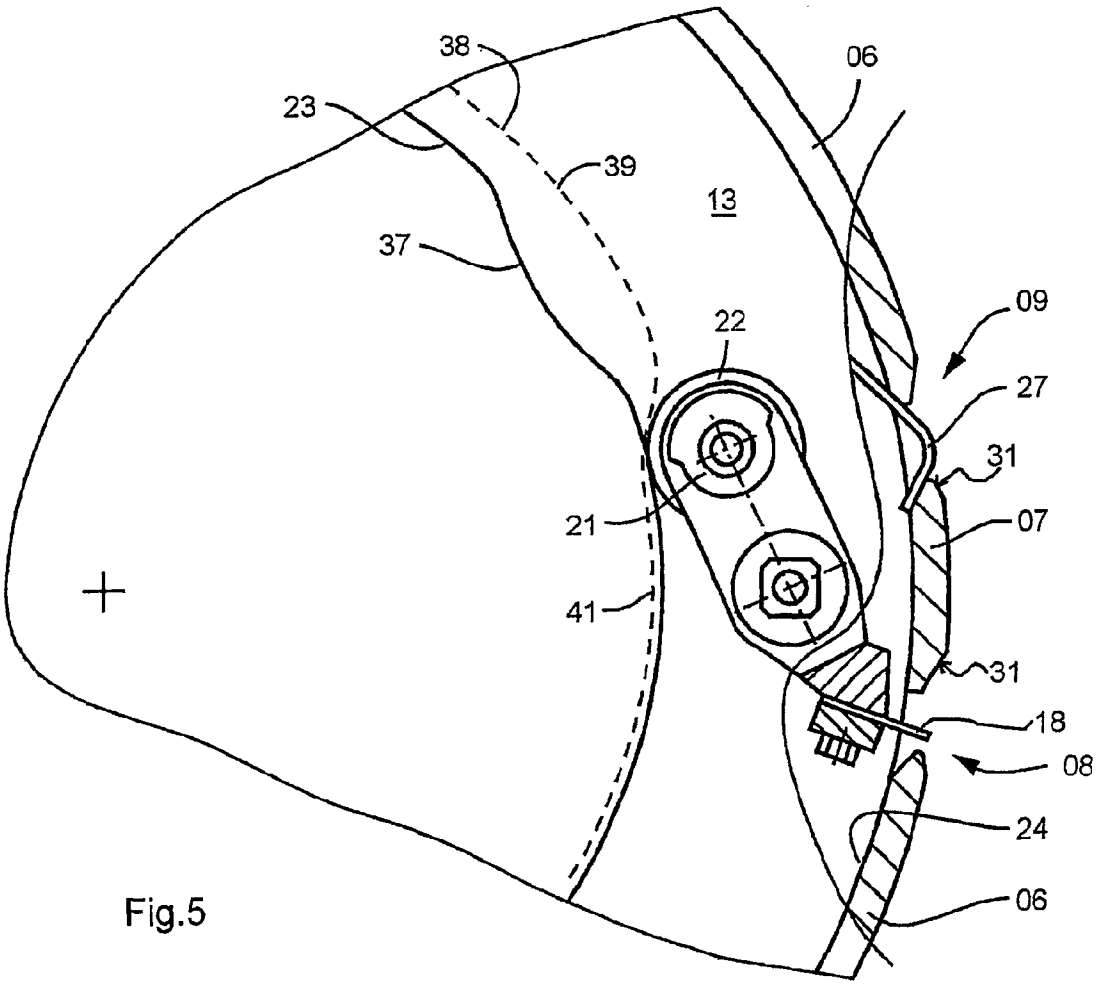

FIG. 5 shows a partial cross-section of a folding blade cylinder in accordance with a third further embodiment of a folding blade cylinder in a plan view analogous to the views shown in FIGS. 3 and 4. The structure of the rotating elements of the folding blade cylinder are the same as with the previously discussed embodiments and will not be described again. In this third further embodiment, the folding blade 18 is shown in its retracted position in its folding movement, shortly prior to the roller 22 reaching a depression 37 in the control cam 23, which will cause the folding blade 18 to extend into its active position.

The roller 22 is wider than the control cam 23.

A second control cam 38 is represented as a dashed outline in FIG. 5. During normal operation of the folding blade cylinder, this second control cam 38 is spaced apart from the first control cam 23 sufficiently far so that the roller 22 cannot touch it.

The second control cam 38 has areas 39, 41 of two different radii, wherein the radius of the smaller radius area 41 is slightly less than the radius of the control cam 34 in its area corresponding to the inactive state of the folding blade 18, while the radius of the larger radius area 39 of the second control cam 38 is clearly greater than this value.

To perform the displacement of the folding blades 18, the second control cam 38, which is initially situated in its orientation represented in FIG. 5, is axially displaced in the direction of the first control cam 23, so that at least a portion of its width comes to lie underneath the roller 22. Thereafter, the second control cam 38 is turned in a clockwise direction, as depicted in FIG. 5. This causes the roller 22 to be supported by the larger radius area 39 of the second control cam 38. The roller 22 is thus lifted off the first control cam 23, and the folding blade 18 is retracted radially inwardly sufficiently far beyond its inactive position represented in FIG. 5 into the interior of the folding blade cylinder so that the tip of the folding blade 18 clearly lies inside the inner surface 24 of the cradle 03. In this state, the displacement of the folding blade 18 can be performed in the same way as in the previously described embodiments. Thereafter, the second control cam 38 is again moved away from the first control cam 23, so that the latter can again take up its function of controlling the folding movement of the folding blade 18.

The embodiments shown and discussed are based on folding blade cylinders with three folding blades, which three folding blades can be displaced between respectively two gaps. The invention can also be used in connection with folding blade cylinders with any arbitrary number of folding blades and more than two gaps.

In the above described and depicted embodiments, a closing body 27 is only provided for the gaps 09. A corresponding closing body could also be arranged on the opposite side of the folding blade 18 in order to close the gap 08 when the folding blade 18 is positioned at the gap 09.

The folding blade 18 can be displaced between a working position, in which the folding blade 18 is arranged at least at times outside of a cradle 03, and a position of rest, in which the folding blade 18 is arranged inside the cradle 03. In the process, the tip of the folding blade 18 can be displaced, in a circumferential direction in relation to the cradle 03, inside the cradle 03 so that it is moved along underneath segments 07 of the cradle 03.

While preferred embodiments of a folding blade cylinder of a folding blade machine in accordance with the present invention are set forth fully and completely hereinabove, it will be apparent to one of skill in the art that various changes in, for example, the overall sizes of the cylinders, the drives for the cylinders, the sizes of the sheets being folded and the like could be made without departing from the true spirit and scope of the present invention which is accordingly to be limited only by the following claims.

What is claimed is:

1. A folding blade cylinder of a folding apparatus comprising:

a cylindrical cradle;

at least first and second of axially extending, circumferentially spaced gaps in said cylindrical cradle;

a folding blade within said cylindrical cradle, said folding blade being selectively extendable through a selected one of said at least first and second circumferentially spaced cradle gaps; and means for circumferentially displacing said folding blade, while said folding blade is in a rest position in an interior of the folding blade cylinder between selected at least first and second folding blade positions each of which selected at least first and second folding blade positions is located opposite a selected one of said at least first and second circumferentially spaced cradle gaps.

2. The folding blade cylinder of claim 1 wherein said cradle includes cradle segments including thin cradle segments and wherein said folding blade is displaceable beneath one of said thin cradle segments.

3. The folding blade cylinder of claim 1 further including a first folding blade control cam and a folding blade lever, said lever riding on said first folding blade control cam and controlling extension of said folding blades through said selected ones of said cradle gaps.

4. The folding blade cylinder of claim 3 further including an actuator adapted to lift said folding blade lever off said first folding blade control cam.

5. The folding blade cylinder of claim 4 wherein said actuator is a linear actuator selected from a group including a working cylinder and an electromagnetic actuator.

6. The folding blade cylinder of claim 4 including a second control cam that is rotatable with respect to said first control cam, said second control cam being said actuator.

7. The folding blade cylinder of claim 1 further including a folding blade spindle supporting said folding blade, said folding blade spindle being fixed in place in the folding blade cylinder with respect to said cradle gaps during extension of said folding blade.

8. The folding blade cylinder of claim 1 further including a folding jaw cylinder opposing the folding blade cylinder.

9. The folding blade cylinder of claim 1 wherein said folding blade is movable between an extended active position and a retracted inactive position and further wherein said cradle has an inner surface, said folding blade in said retracted inactive position being located radially interiorly of said cradle inner surface.

10. The folding blade cylinder of claim 9 wherein said cradle includes cradle segments including thin cradle segments and wherein said folding blade can be displaced behind one of said thin cradle segments.

11. The folding blade cylinder of claim 1 further including beveled outer edges on said cradle gaps.

12. The folding blade cylinder of claim 1 further including a gap closing body associated with ones of said cradle gaps not associated with said folding blade.

13. The folding blade cylinder of claim 12 wherein said gap closing body is displaceable with said folding blade.

14. The folding blade cylinder of claim 13 wherein said cylinder gaps closable by said gap closing body have bevels on gap sides facing each other.

15. The folding blade cylinder of claim 14 further including a spring element, said spring element exerting a radially outwardly directed force on said gap closing body.

16. The folding blade cylinder of claim 15 wherein said spring element and said gap closing body are one piece of sheet metal strip.

17. The folding blade cylinder of claim 13 further including a spring element, said spring element exerting a radially outwardly directed force on said gap closing body.

18. The folding blade cylinder of claim 17 wherein said spring element and said gap closing body are one piece of sheet metal strip.

* * * * *